US005492056A

United States Patent [19]

Hansen

[11] Patent Number: 5,492,056

[45] Date of Patent: Feb. 20, 1996

[54] APPARATUS FOR COMPACTING REFUSE MATERIAL IN A VESSEL

[76] Inventor: Henry Hansen, Markus Meyers väg 8, S-432 52 Varberg, Sweden

[21] Appl. No.: 318,634

[22] PCT Filed: Apr. 8, 1993

[86] PCT No.: PCT/SE93/00309

§ 371 Date: Oct. 5, 1994

§ 102(e) Date: Oct. 5, 1994

[87] PCT Pub. No.: WO93/21007

PCT Pub. Date: Oct. 28, 1993

[30] Foreign Application Priority Data

Apr. 13, 1992 [SE] Sweden ..... 9201171

[51] Int. Cl.[6] ..... B30B 9/30

[52] U.S. Cl. ..... 100/65; 100/210

[58] Field of Search ..... 100/65–68, 156, 100/210

[56] References Cited

U.S. PATENT DOCUMENTS

| | | | |
|---|---|---|---|
| 3,720,052 | 3/1973 | Anderson et al. | 100/210 |
| 4,426,925 | 1/1984 | Bergmann | 100/65 |
| 4,524,685 | 6/1985 | Bergmann | 100/210 |

FOREIGN PATENT DOCUMENTS

| | | | |
|---|---|---|---|
| 3406879 | 8/1985 | Germany | 100/67 |
| 586309 | 12/1958 | Italy | 100/68 |
| 399208 | 6/1975 | Sweden . | |
| 934984 | 6/1982 | U.S.S.R. | 100/210 |

*Primary Examiner*—Stephen F. Gerrity
*Attorney, Agent, or Firm*—Dvorak and Traub

[57] ABSTRACT

An apparatus for compacting refuse and similar material in a vessel. The apparatus including a driveable rotating roller for compacting the material inside a receiver vessel, wherein the roller is capable of moving in an essentially horizontal direction about a shaft and is preferably driven in rotation. In one embodiment, the roller is coupled to the shaft by a support arm extending laterally from the shaft, and is movable in a vertical direction between bottom and top portions of the vessel by a pivot arm.

8 Claims, 8 Drawing Sheets

Fig. 2
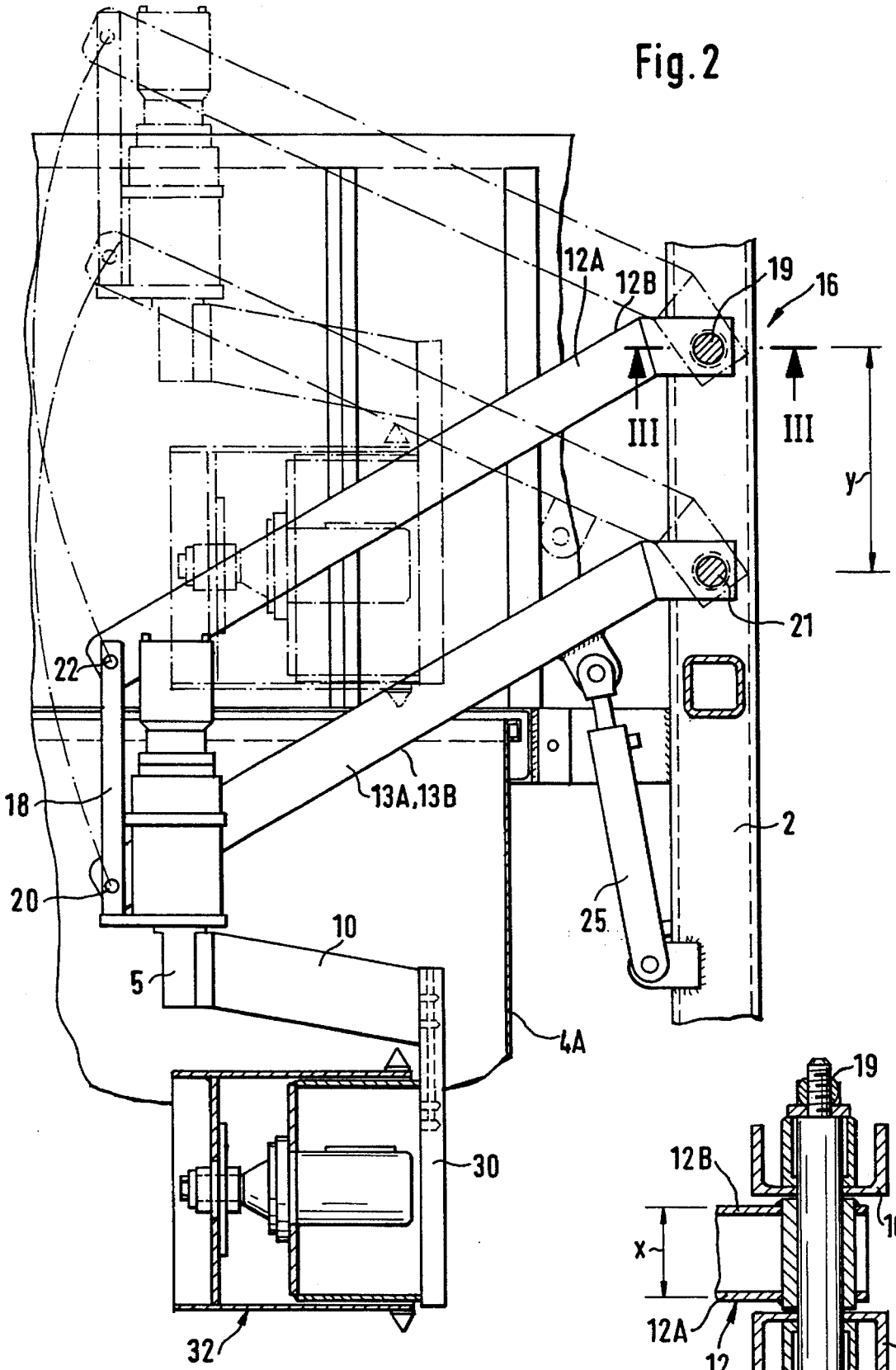
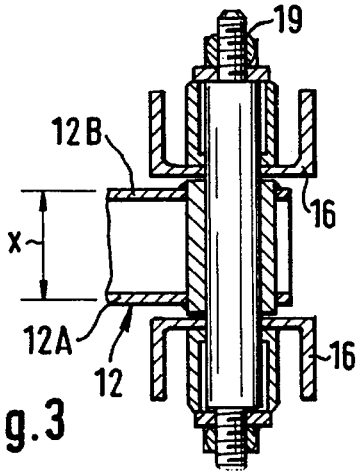
Fig. 3

APPARATUS FOR COMPACTING REFUSE MATERIAL IN A VESSEL

The present invention relates to an arrangement for a compacting plant for refuse and similar material, which comprises a drivable rotating roller for compacting the material inside a receiver vessel and capable of moving in an essentially horizontal direction about an essentially vertical shaft, preferably driven in a rotary fashion, which roller can be supported enabling it to be moved in a direction between the bottom of the vessel and its upper part.

BACKGROUND OF THE INVENTION

A problem associated with compacting plants of the kind referred to above is the need to be able to achieve even compaction along essentially the whole of the material accommodating space of a vessel, and to be able to support a compaction roller by simple, yet effective and reliable means.

Previously disclosed in, for example, European Patents 0 106 268 and 0 315 674 are compactors with a compaction roller pivotally mounted about a vertical central shaft, in conjunction with which said roller runs on the same path and leaves an area free of compaction, i.e. beneath the central shaft and peripherally around the path of the roller.

In addition, the supports for the roller in these previously disclosed compactors are unnecessarily complex and temperamental in use, for example arms capable of being transported on carriages in upright guide tracks, with the result that large spaces are required in the area above the material receiver vessel.

The principal object of the present invention is thus, in the first place, to enable at least one of the problems and disadvantages referred to above to be solved by simple and efficient means.

Said object is achieved by means of an arrangement in accordance with the present invention, which is characterized essentially in that the vertical, and preferably rotatable shaft is capable of lateral displacement and/or is supported telescopically.

BRIEF DESCRIPTION OF THE DRAWINGS

The invention is described below as a number of preferred illustrative examples, in conjunction with which reference is made to the drawings, in which

FIG. 2 shows the arm arrangement;

FIG. 3 shows a section along the line III—III in FIG. 2;

DETAILED DESCRIPTION OF THE INVENTION

Figure 1:
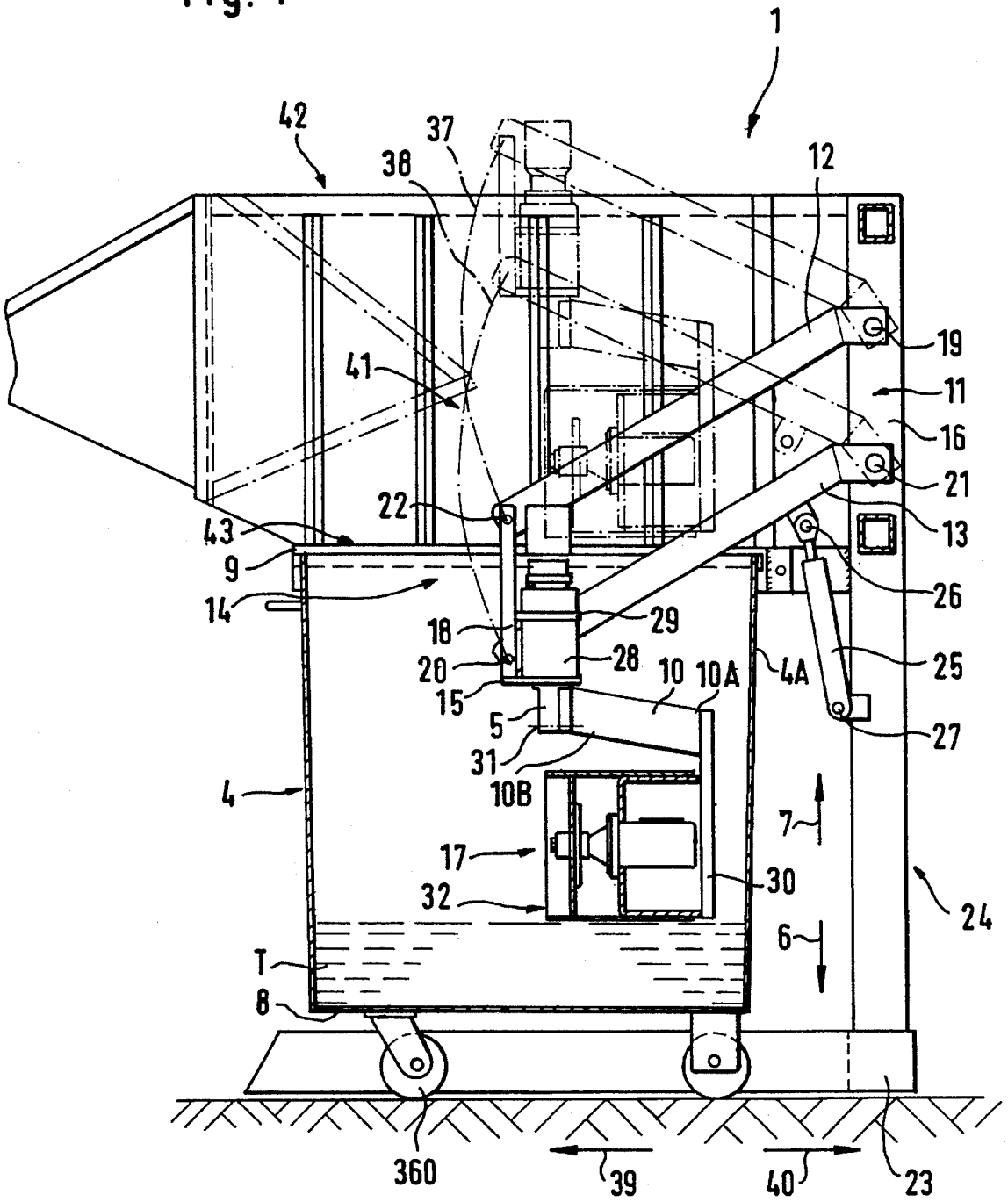
FIG. 1 shows a first illustrative embodiment of a compacting plant.
Figure 4:
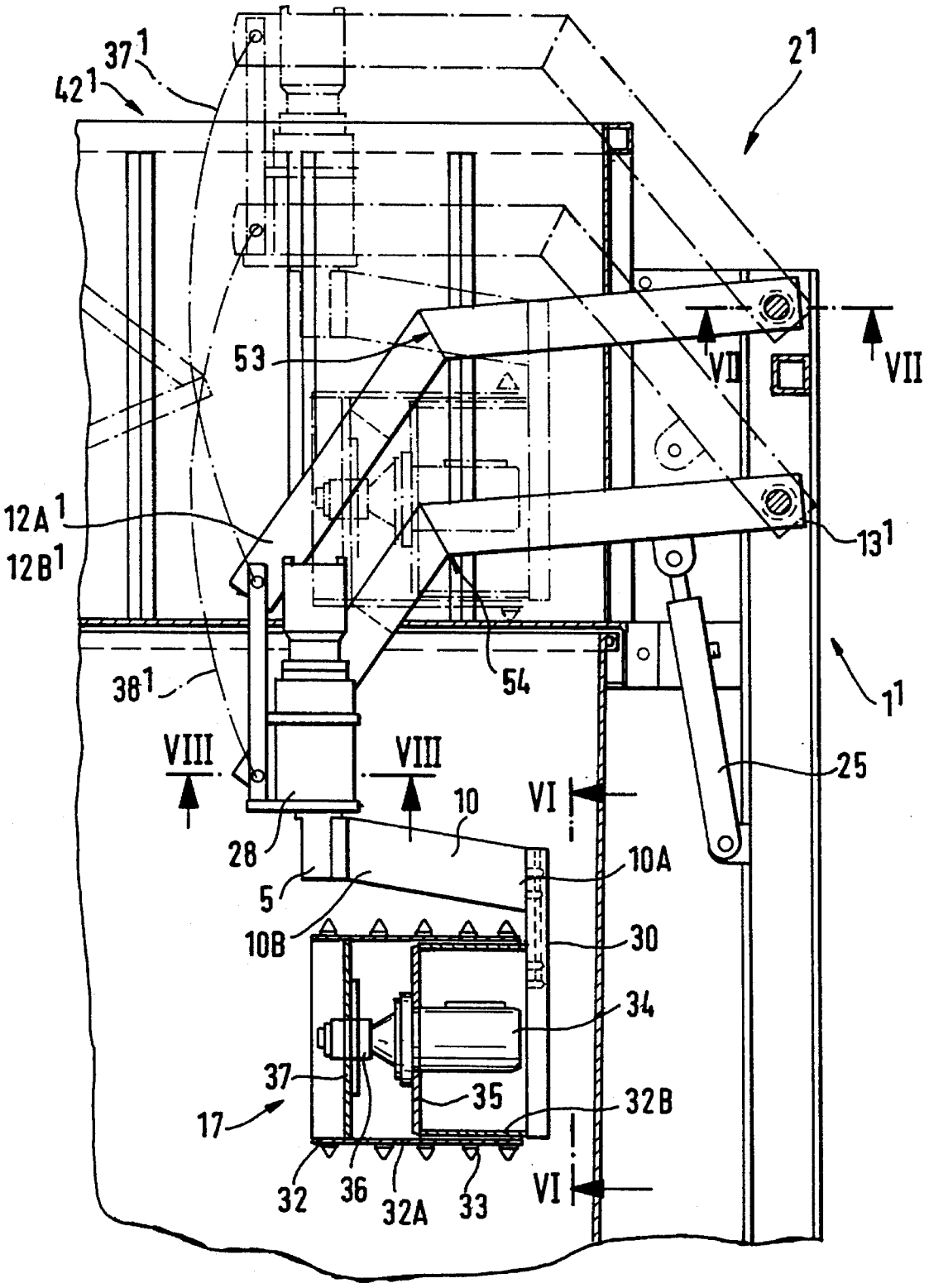
FIGS. 4 and 5 show a second illustrative embodiment of a plant viewed from the side and in elevation.

An arrangement 1 for use in a compacting plant 2 intended for refuse T or similar material which comprises at least one drivable rotating roller 32 for compacting the material inside a receiver vessel 4 in an essentially horizontal direction, in conjunction with which the roller 32 is capable of moving about an essentially vertical shaft 5, preferably driven in a rotary fashion so that the material is compacted by the roller 32, which roller is so arranged as to be supported enabling it to be moved in a vertical direction 6, 7 between the bottom 8 of the vessel and its upper part 9, in conjunction with which said vertical rotating shaft 5 is supported so as to be capable of lateral displacement.

Figure 13:
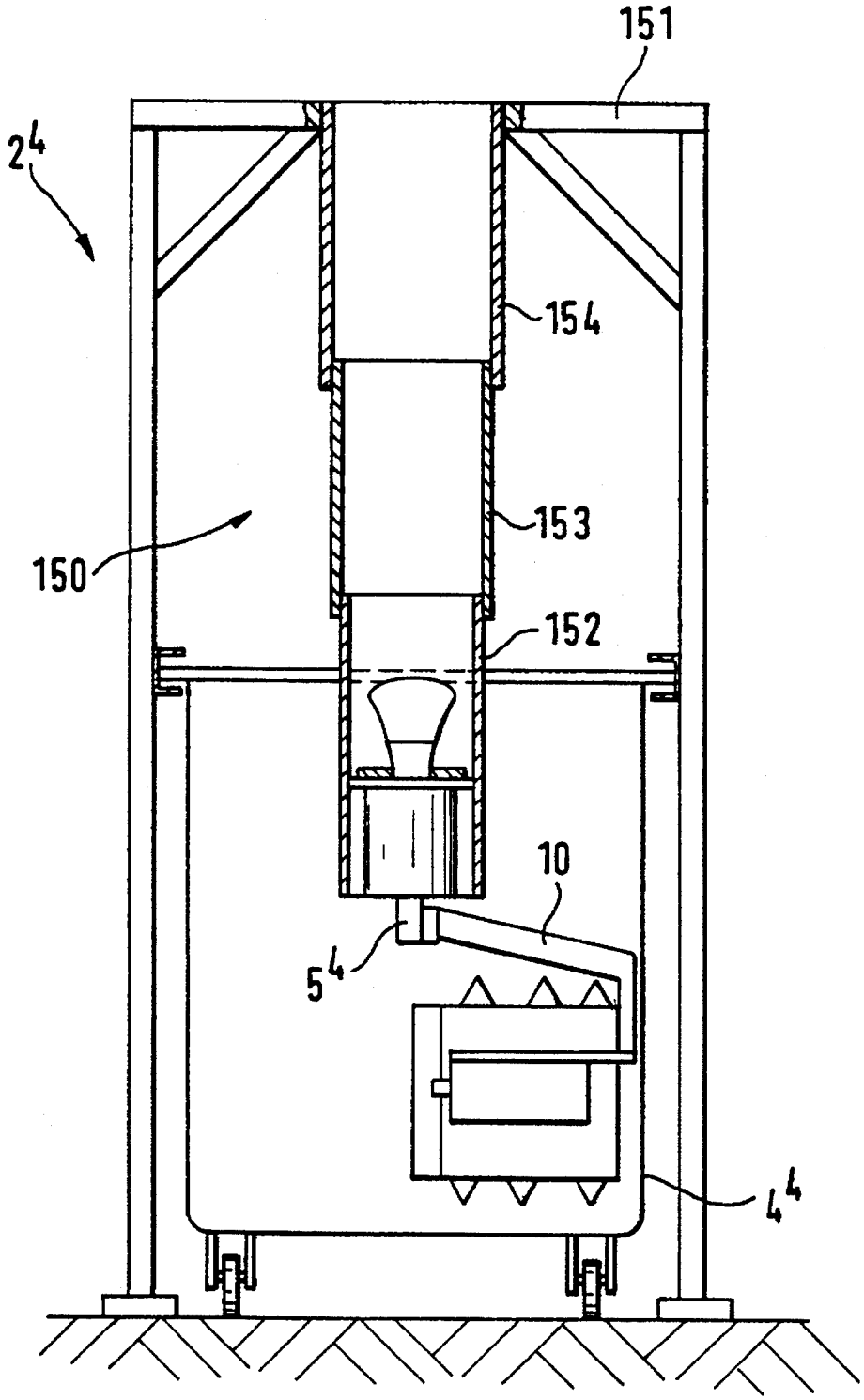
FIG. 13 shows a last embodiment of the plant.

As an alternative or as a complement, said vertical, preferably rotating shaft $5^4$ can be supported telescopically, as shown in FIG. 13, by a telescope 150.

In accordance with the first illustrative example of the invention, which is shown in FIGS. 1–2 in the drawings, the vertical, preferably rotating shaft 5, which supports a roller support arm 10 extending laterally and preferably obliquely downwards towards the outside 4A of the vessel, is supported by a pivot arm arrangement 11. Said pivot arm arrangement 11 is formed preferably by pairs of arms 12, 13, which can be divided laterally into double arm parts 12, 12B; 13A, 13B situated at a mutual distance X and displaced laterally from one another. Said pairs of arms 12, 13 are preferably arranged in parallel, with one arm 12 positioned at a level higher than the other arm 13 and above same at a mutual distance Y from one another, in the form of so-called parallel tie rods, which arms 12, 13 are connected to one another.

Said connection 14 is formed in that the arms 12, 13 are pivotally connected, when viewed in the vertical sense, to a pivot shaft attachment 15 and to a support point 16 for the formed roller arrangement 17, via a parallel link 18 and swivel joints 19, 20, 21, 22.

An upward-projecting frame upright 24 included in the plant 2, for example attached to a base frame 23, or a fixed attachment to the wall of a refuse room or the like, for example, can serve as the support point for the arms 12, 13 with the roller 3.

A jack 25 or some other means of transmitting force is so arranged as to be capable of actuating said pivot arms 12, 13, in conjunction with which the preferably hydraulically driven piston cylinder arrangement 25 acts between the swivel joint attachment 26 on one arm 13 and a swivel joint 27 in a fixed position, for example on the frame upright 24 or a wall.

The illustrative embodiment of a compacting plant $2^1$ and an arrangement $1^1$, as shown in FIGS. 4–8, differs from the previous example primarily through the design of the lifting arms $12^1$, $13^1$. These are executed bent or curved and formed like a fork at one end with pairs of side arm parts $12A^1$, $12B^1$; $13A^1$, $13B^1$, between which a hydraulically acting swivel 28 is accommodated for the purpose of supporting and driving the arm 10 and the roller arrangement 17 in the event of the arrangement being designed to exhibit a roller capable of rotating about the vertical shaft. Extending between each of the pairs of side arm parts $12A^1$, $12B^1$; $13A^1$, $13B^1$ is a shaft 51, 52, which is attached so as to form swivel joints for the parallel links 18, which hold the arms $12^1$, $13^1$ parallel with one another.

The attachments 15, 29 for the swivel 28 are also attached to the links 18.

The roller arrangement 17 is supported via a supporting plate 30 at the lower end 10A of the roller support arm 10, which is preferably inclined at an angle downwards and outwards from the rotating shaft 5, whilst the shaft 5 is attached to the upper end 10B of the arm via. screwed connections 31, etc.

The compacting roller 32 can be divided, in conjunction with which one cylindrical part 32A of the roller is passed over a further cylindrical part 32B of the roller. One 32A of the two roller parts 32A, 32B can exhibit a number of shredding teeth 33 or other compaction/ pressure/tearing devices, whilst the other part 32B of the roller, which is attached to the support plate 30, for example by welding, can form a bearing support for the roller part 32A.

Accommodated internally in the roller 32 is a preferably hydraulic drive motor 34, which is supported by an end plate 35 on the inner part 32B of the roller and is connected with the drive shaft 36 to an internal partition wall 37 in the outer part 32A of the roller.

Hydraulic fluid is transferred via the swivel 28, the arm 10 and the plate 30 to the motor 34 for the purpose of driving the roller 32 and compacting the material T in the vessel 4 as the arm 10 is caused to pivot with the help of and about the shaft 5. As the quantity of material T increases in the vessel 4, which may consist of a sturdy plastic or metal vessel, for example with wheels 360, or a sack accommodated in a sack support during filling of the material and compacting of same, although this is not shown in the drawings, the roller arrangement 17 is appropriately raised through the effect of the jack 25 until the vessel 4 is filled with finally compacted material T. The arms 12, 13; $12^1$, $13^1$ are caused to pivot for this purpose along corresponding pivot paths 37, 38; $37^1$, $38^1$. This causes the roller 32 to change position in the vessel 4 when viewed from the side, in conjunction with which the roller 32 compacts the material T along a path other than the previous path at a different compaction level, i.e. along a circular path, the central axis of which is displaced laterally 39, 40, first in one direction 39 and then in the other direction 40, i.e. the direction changes once the pivot paths of the pivot arms have crossed one another at a point 41. Compaction of the material T thus takes place over a larger area than in previously disclosed refuse compactors.

The design of the lifting arms $12^1$, $13^1$ with an angled central part 53, 54 means that the total pivot height for the arms $12^1$, $13^1$ can be kept low, and that the total height is thus small, even with the arms $12^1$, $13^1$ pivoted fully upwards when replacing the vessel 4, which is advantageous in refuse rooms with a low ceiling height.

Side supports 55, 56 for the vessel 4 may be provided, for example in the form of struts, and may be attached to a frame $23^1$. The vessel 4 is introduced between the supports 55, 56 and is held in position by them during compaction.

Figure 5:
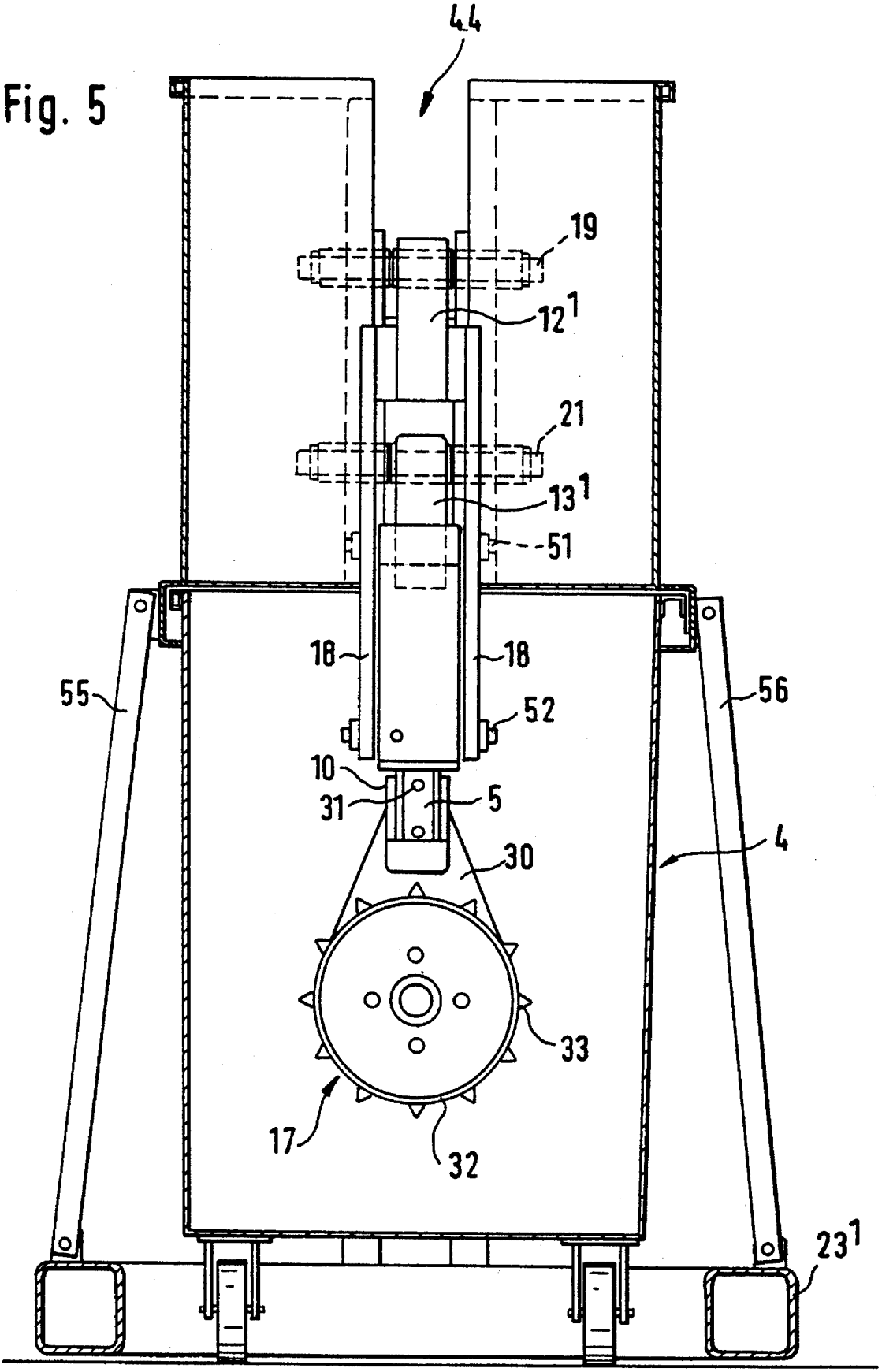
Figure 6:
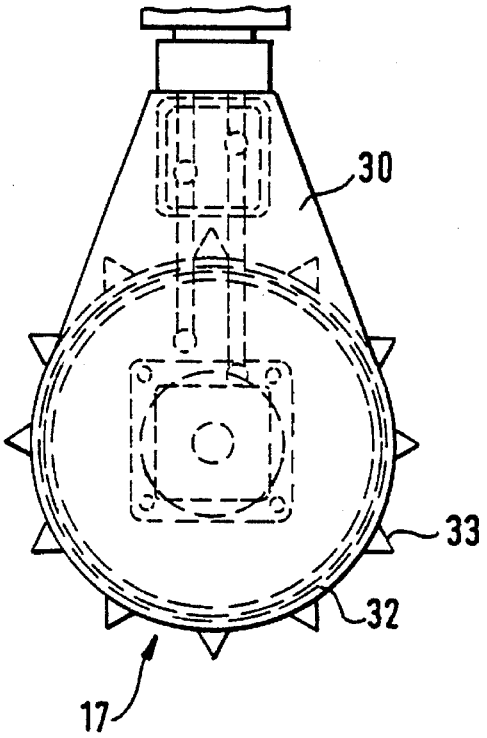
FIGS. 6–8 show a section along the lines VI—VI, VII—VII and VIII—VIII in FIG. 4.
Figure 7:
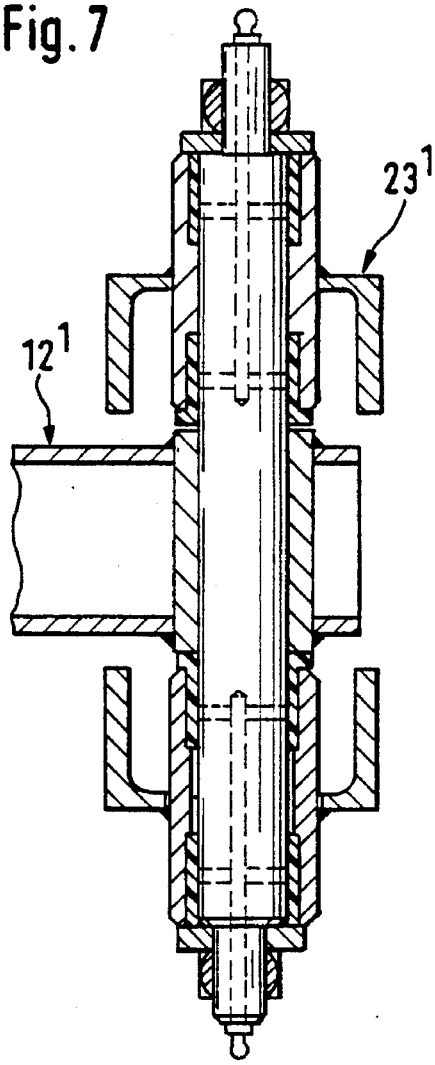
Figure 8:
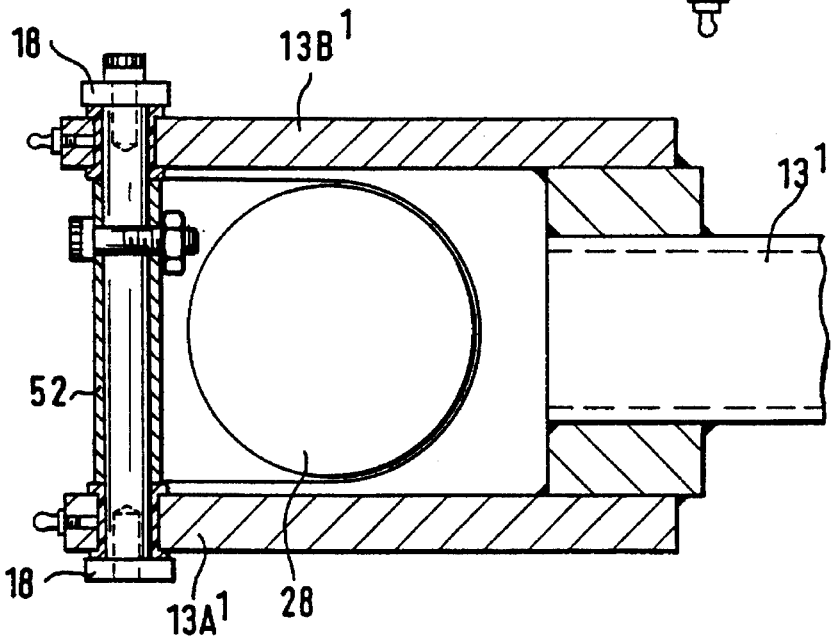

A receiving arrangement 42, $42^1$, for example of the funnel type, may be connected to the upper material opening 43 of the vessel, in conjunction with which a slot 44 to accommodate the roller lift arms 12, 13; $12^1$, $13^1$ is situated in it, for example as shown in FIG. 5.

Figure 10:
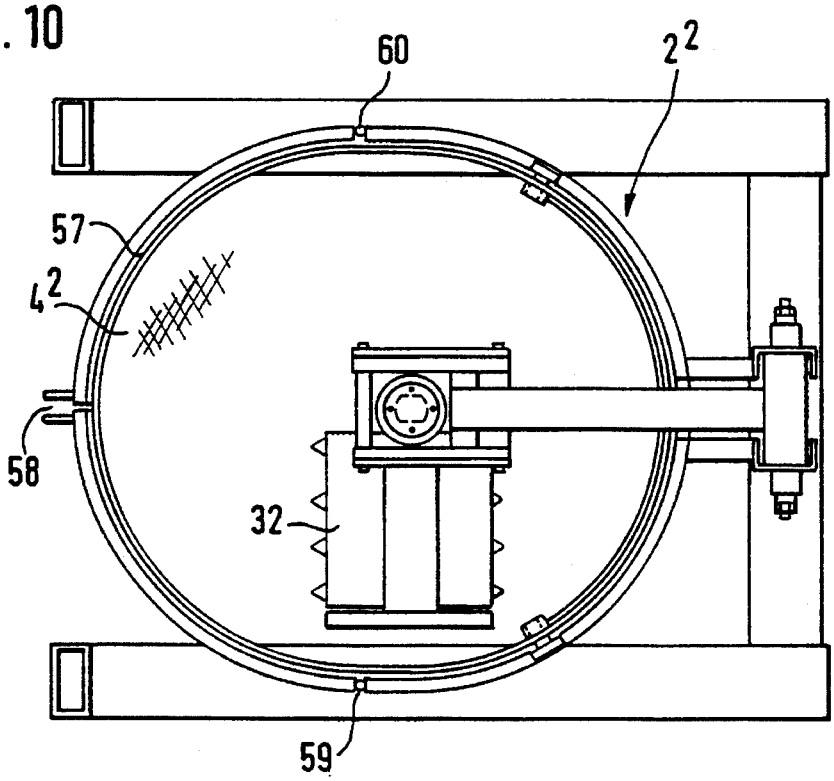
Figure 12:
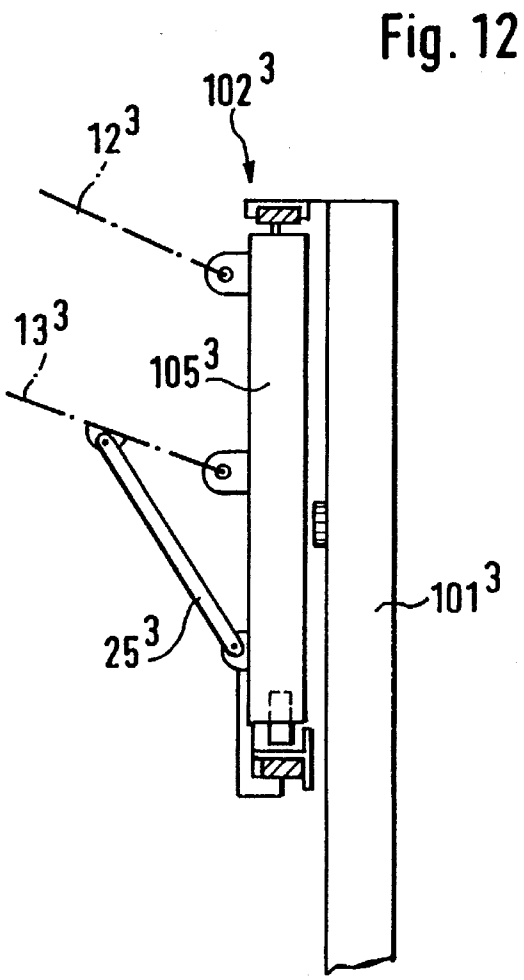
FIG. 12 shows a detail adapted for the plant in FIG. 11.

FIG. 10 shows a top view of a plant $2^2$ of circular vessel form, i.e. sacks $4^2$ made of a plastic material, for example, are so arranged as to be capable of being accommodated inside an outer layer 57 of hard material, in conjunction with which said outer layer can be parted at an opening 58 and can be swung out of the way about swivel joints 59, 60 to permit the sack $4^2$ to be replaced.

Figure 9:
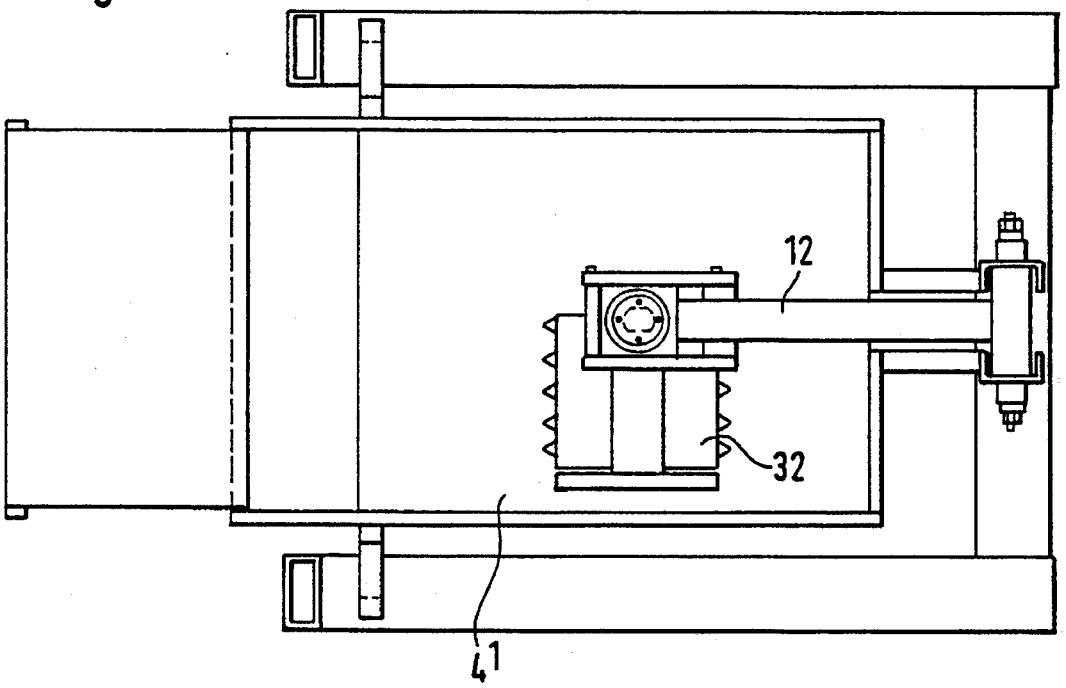
FIGS. 9 and 10 show different forms of plants.

FIG. 9 shows a top view of a plant $2^1$ with square container walls $4^1$, which may be tippable by means of the lifting gear on the refuse collection vehicle.

Figure 11:
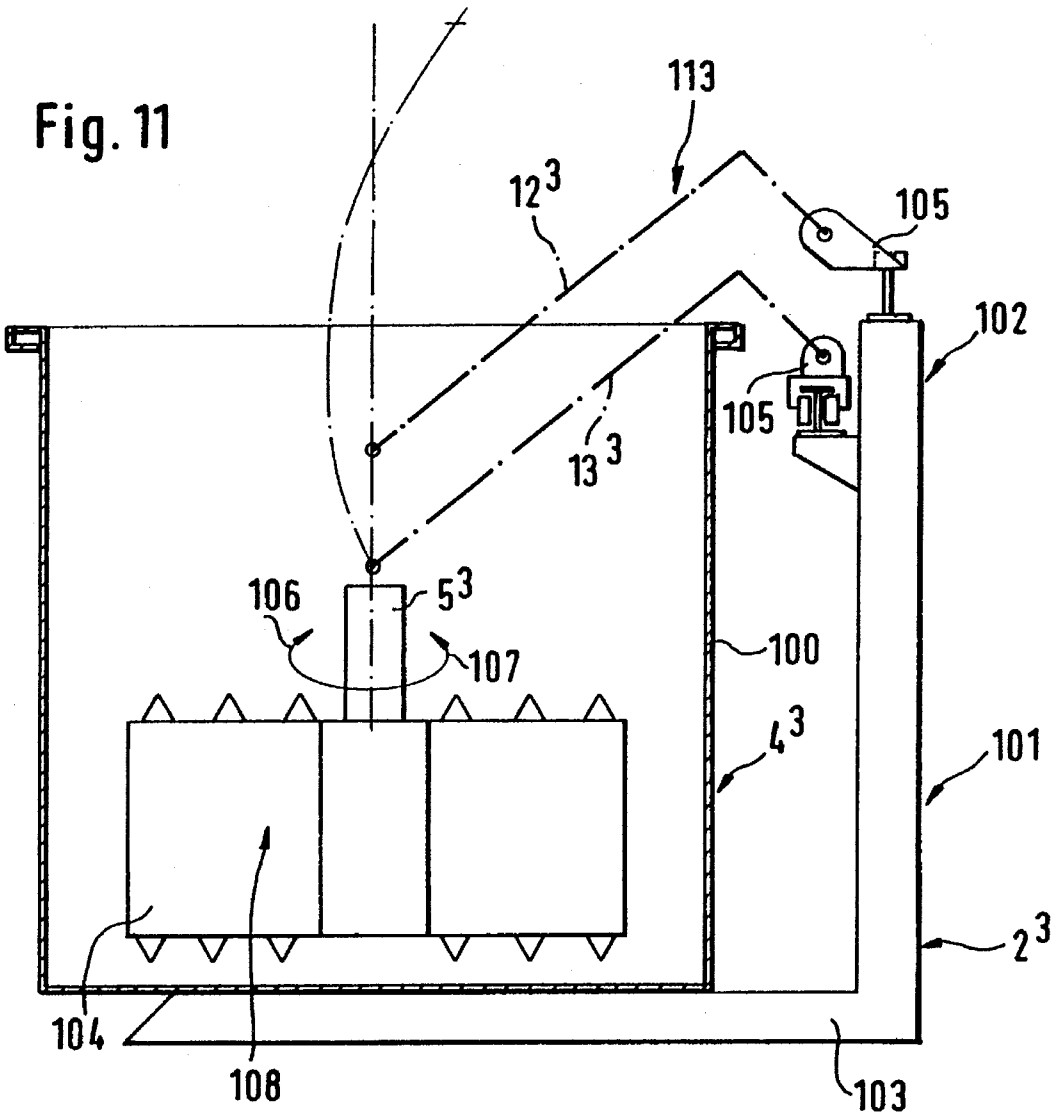
FIG. 11 shows a third illustrative example of a plant.

FIG. 11 shows a variant of the plant $2^3$ with a vessel in the form of, for example, an upwardly open container $4^3$. A support arrangement in the form of, for example, uprights 101 or other raised elements $101^3$ with tracks 102,$102^3$ can be arranged along one long side 100 of said container and can be attached, for example, to a support 103 capable of being positioned beneath the container $4^3$. It is possible in this way for the vertical shaft $5^3$, which at its lower end supports a transverse driveable compaction roller 104, to be supported in such a way as to be capable of being displaced and, should the occasion arise, as to be capable of being caused to rotate along the material receiving vessel about said vertical shaft $5^3$.

The vertical shaft $5^3$ is supported by a pivot arm arrangement $11^3$, which is connected to a carrier 105, $105^3$ capable of moving along a path, preferably a carriage attached to tracks 102, $102^3$ extending along the vessel $4^3$. This compaction roller 104 can thus be driven in the longitudinal sense of the container along the path when the arms $12^3$, $13^3$ are supported by the carriage/carriages 105, $105^3$ and caused to move along said tracks 102, $102^3$, with the rotating effect of the roller 104 both about the vertical axis $5^3$ in the direction 106, 107 and about a horizontal axis of rotation 108.

Lifting of the arms $12^3$, $13^3$ and the roller 104 can also be achieved by means of a jack $25^3$, as in previous examples.

The driving effect of the roller 104 from the outside of the container can also take place, for example, by means of a toothed rail or some other driving means running along the track.

Finally, FIG. 13 shows a variant of an arrangement $2^4$ in which the vertical and preferably pivotable shaft $5^4$, which supports a supporting arm 10 extending laterally towards the outside of the vessel, is supported by a portal superstructure 151 extending over the upper part of a moving material receiving vessel $4^4$ via a number of suspended lifting arms 152, 153, 154 capable of being accommodated lengthwise alongside one another.

The lifting arms can be formed from sleeves capable of telescoping into one another and with internally accommodated hydraulic lines, etc., for the supply of the fluid for driving the roller.

Such a reliable and efficiently functioning compaction plant can now be achieved through said simple invention, although it is not restricted to the embodiments described above and illustrated in the drawings, but may be modified within the scope of the Patent Claims without departing from the idea of invention.

I claim:

1. An apparatus for compacting refuse material inside a vessel, the apparatus comprising:

a driveable rotating roller for compacting the refuse material inside the vessel;

an essentially vertical rotatable shaft coupled to the driveable rotating roller for moving the driveable rotating roller in the vessel; and a pivot arm coupled at one end to the essentially vertical shaft and pivotally coupled at another end to a support, wherein the driveable rotating roller is movable between a bottom and a top part of the vessel upon pivoting the pivot arm.

2. An apparatus in accordance with claim 1, wherein the essentially vertical shaft is coupled to the driveable rotating roller by a support arm extending laterally from the essentially vertical shaft towards a side portion of the vessel, and the pivot arm is formed by pairs of arms arranged in parallel to one another.

3. An apparatus in accordance with claim 1, wherein the pairs of arms are pivotally connected at one end to a link by a pivot shaft attachment and to the support by a pivot shaft attachment.

4. An apparatus in accordance with claim 3, wherein the support is a frame upright.

5. An apparatus in accordance with claim 3, wherein the support is a wall.

6. An apparatus in accordance with claim 1, wherein the essentially vertical shaft supports a transverse compaction roller displacable along the material receiving vessel.

7. An apparatus in accordance with claim 6, wherein the pivot arm is coupled to a carriage attached to channels extending along the vessel.

8. An apparatus in accordance with claim 1, further comprising a jack coupled to the pivot arm for pivoting the pivot arm.

* * * * *